US005188305A

United States Patent [19]

Kitamura

[11] Patent Number: 5,188,305

[45] Date of Patent: Feb. 23, 1993

[54] APPARATUS FOR CUTTING WINDING STRIPS FOR USE IN A WOUND CORE

[75] Inventor: Fumio Kitamura, Chino, Japan

[73] Assignee: Kitamura Kiden Co., Ltd., Chino, Japan

[21] Appl. No.: 924,416

[22] Filed: Jul. 30, 1992

Related U.S. Application Data

[63] Continuation of Ser. No. 788,249, Nov. 5, 1991, abandoned, which is a continuation of Ser. No. 409,432, Sep. 19, 1989, Pat. No. 5,115,703.

[30] Foreign Application Priority Data

Sep. 27, 1988 [JP] Japan ..... 63-239728

[51] Int. Cl.[5] ..... B26D 1/24; H01F 41/02

[52] U.S. Cl. ..... 242/56.2; 83/156; 83/490; 83/495; 242/7.07

[58] Field of Search ..... 83/32, 46, 47, 48, 156, 83/490, 491, 492, 495, 496, 497, 500, 84; 29/605, 564.7; 336/42; 242/7.12, 7.07, 56.2; 226/21, 45

[56] References Cited

U.S. PATENT DOCUMENTS

| | | | |
|---|---|---|---|
| 4,711,019 | 12/1987 | Albeck et al. . | |
| 4,842,208 | 6/1989 | Kitamura | 242/56.2 |
| 4,844,312 | 7/1989 | Gomi et al. | 226/21 |
| 4,848,684 | 7/1989 | Sasaki et al. | 242/1 |

FOREIGN PATENT DOCUMENTS

| | | |
|---|---|---|
| 243756 | 11/1987 | European Pat. Off. . |
| 75577 | 6/1894 | Fed. Rep. of Germany . |
| 860825 | 12/1952 | Fed. Rep. of Germany . |
| 938860 | 2/1956 | Fed. Rep. of Germany . |
| 2719075 | 11/1977 | Fed. Rep. of Germany . |
| 2565216 | 12/1985 | France . |
| 55-132027 | 10/1980 | Japan . |
| 60-28375 | 7/1985 | Japan . |
| 61-22851 | 6/1986 | Japan . |
| 63-132408 | 6/1988 | Japan . |
| 63-132412 | 6/1988 | Japan . |
| 63-168013 | 7/1988 | Japan . |
| 63-168014 | 7/1988 | Japan . |
| 63-188916 | 8/1988 | Japan . |
| 2154494 | 9/1985 | United Kingdom . |

OTHER PUBLICATIONS

Abstract of Soviet Patent No. 1343-452-A, May 24, 1985, entitled "Choke magnetic cores of balance system mfg . . . ", published in *Soviet Inventions Illustrated*, Sec. El: Electrical, week 8818, Jun. 15, 1988, Derwent Publications Ltd., 2 pages.

*Primary Examiner*—Frank T. Yost
*Assistant Examiner*—Scott A. Smith
*Attorney, Agent, or Firm*—Merchant, Gould, Smith, Edell, Welter & Schmidt

[57] ABSTRACT

When a material having two straight lines is cut into a plurality of series of strips along a plurality of predetermined curves, one series of strips is in direct contact with another adjacent series of strips.

1 Claim, 13 Drawing Sheets

APPARATUS FOR CUTTING WINDING STRIPS FOR USE IN A WOUND CORE

This is a continuation of application Ser. No. 07/788,249, filed Nov. 5, 1991, now abandoned which is a continuation of application Ser. No. 07,409,432, filed Sep. 19, 1989, now U.S. Pat. No. 5,115,703, issued on May 26, 1992.

BACKGROUND OF THE INVENTION

1. Field of the invention

The present invention relates to a method of cutting strips for a wound core of a transformer to which a cylindrical coil bobbin is applied.

2. Description of the Related Art

As the iron cores of transformers, wound cores in which a strip having excellent magnetic characteristics is wound in a ring shape are now used. For example, a wound core is obtained by winding a strip material on a winding spool to obtain a square, rectangular, stepwise, or circular cross-section (see: Kokoku Nos. 60-28375 and 61-22851, and Kokai No. 55-132027). To form this wound core, two split cylindrical coil bobbins are pressure welded at pressure welding faces thereof, and windings are wound on the coil bobbins.

In the prior art, a material having straight line sides is cut along one or more predetermined curves to obtain one or more series of strips, as explained later in detail. In this case, however, unused portions remain between the series of strips, which is disadvantageous from the viewpoint of an efficient material utilization.

In addition, the above-mentioned material is cut from a very wide silicon steel plate by using a plate slitter apparatus. In this case, however, since the plate-slitter apparatus is composed of a pair of shafts to which a large number of round blades are attached, the inner stress within the material in the width direction due to the curting operation cannot be released, and as a result, a large distortion is generated in the cut portion of the plate. Also due to the configuration of the above-mentioned pair of shafts, it is impossible to carry out an ideal shear process, thereby causing a scrathing of the cut material, and as a result, another large distortion is generated on the cut portions of the plate. Such a large distortion cannot be removed even by heat annealing after the curring operation, and thus the magnetic characteristics are impaired.

Further, for economic reasons, usually the center portion of a directional silicon steel plate, which has relatively excellent magnetic characteristics, is used mainly for heavy electrical components and the like, and the side portions of the directional silicon steel plate are used for strips for wound cores. However, the surfaces of the side portions of the plate are uneven due to the manufacturing process thereof and in addition, defects such as cracks and holes are often generated therein. Such defects should be naturally removed when cutting the material for a wound cores from the plate, but may remain due to the high manufacturing yield. These defects reduce the magnetic characteristics and other physical characteristics.

Still further, a material coil for wound cores is heavy, and the thickness thereof is very thin, i.e., 0.02 to 0.03 cm, and the surface thereof is slightly uneven. Therefore, even when a protection process such as a paper wrapping process is carried out, the end faces of the material coil in the width direction are easily damaged during shipping or transfer and the like. Such damage in the width direction leads to a malfunction of the magnetic characteristics and other physical characteristics.

The above-mentioned defective portions are generated on one side or on both sides of a cut material, thus creating a large number of defective products. Particularly, when it is impossible to determine that a product is defective from the appearance thereof, so that such a product is not determined to be defective until a final stage test, the manufacturing cost is increased.

Note that, to completely remove the above-mentioned defective portions from a material for strips, it is possible to reduce the width of the strip material, but this increases the manufacturing cost of the material.

SUMMARY OF THE INVENTION

An object of the present invention is to provide a method of cutting strips for a wound core by which the manufacturing cost of the strips is reduced.

Another object of the present invention is to provide an apparatus for carrying out the above-mentioned method.

According to the present invention, when a material having two straight lines is cut into plurality of series of strips along a plurality of predetermined curves, one series of strips is in direct contact with another adjacent series of stripes.

Also, there is provided a cutting apparatus which comprises slitter blades for cutting the material along the predetermined curves; a base for supporting the slitter blades; a pivot shaft, positioned immediately below the slitter blades, for supporting the base in parallel with the material; guide rollers for sandwiching the material; an adjusting mechanism for adjusting the base; and a temporary winding frame for winding a series of strips.

Accordingly, little material remains between the two series of strips, and thus the utilization efficiency is raised.

Also, defective portions positioned on one side or both sides of the material are removed from the cut strips.

BRIEF DESCRIPTION OF THE DRAWINGS

The present invention will be more clearly understood from the description given with reference to the accompanying drawings, wherein.

DESCRIPTION OF THE PREFERRED EMBODIMENTS

Before the description of the embodiments of the present invention, prior are methods of cutting strips for a wound core will be explained with reference to FIGS. 1, 2, 3, and 4.

Figure 1:
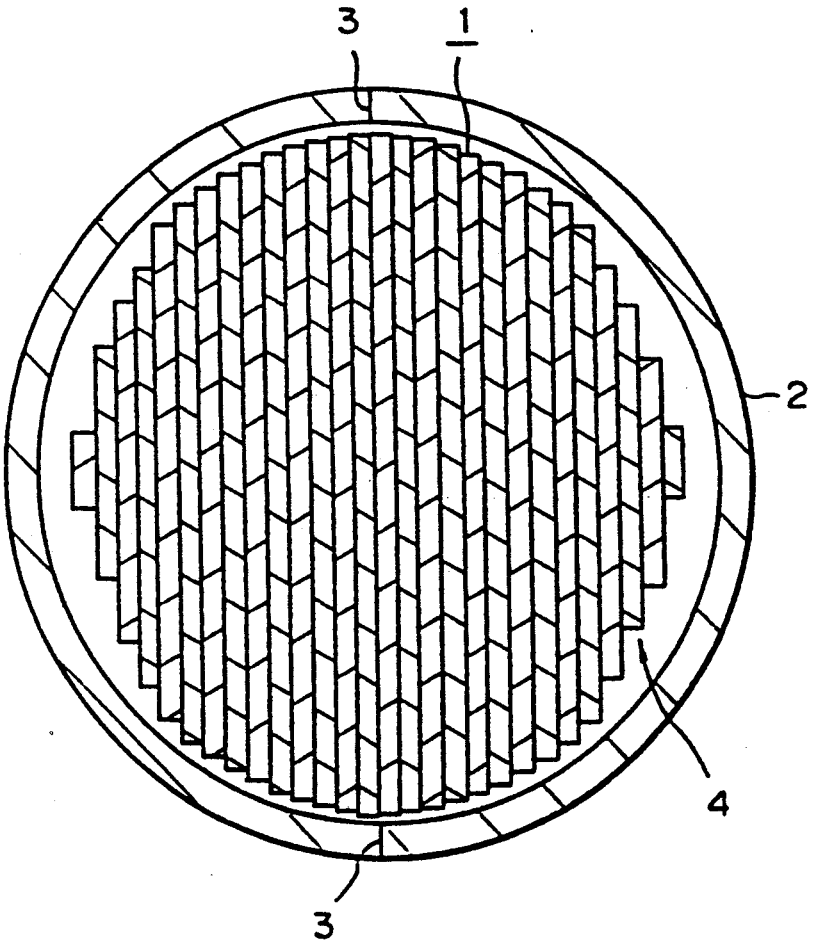
FIG. 1 is a cross-sectional view showing an example of a wound core.

In FIG. 1, which is a cross sectional view of a wound core, a wound core 1 is obtained by winding a shaped strip having a predetermined width and excellent magnetic characteristics on a spool to form a circular cross section. To form this wound core 1, two split cylindrical coil bobbins 2, are pressure welded at pressure welding faces 3 thereof, and the windings (not shown) are wound on the coil bobbin 2 by rotating the coil bobbin 2 with respect to the wound core 1. Therefore, in this case, an air gap 4 between the wound core 1 and the coil bobbin 2 becomes small, and thus excellent magnetic characteristics are obtained. Note that the air-gap 4 is provided to avoid the scratching of the coil bobbin 2 and difficulties with the pressure welding.

Figure 2:
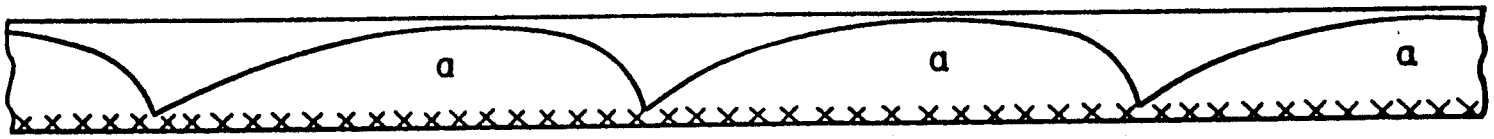
Fig. 2 PRIOR ART
FIGS. 2 , 3, and 4 are plan views showing prior art methods of cutting strips for a wound core.
Figure 3:
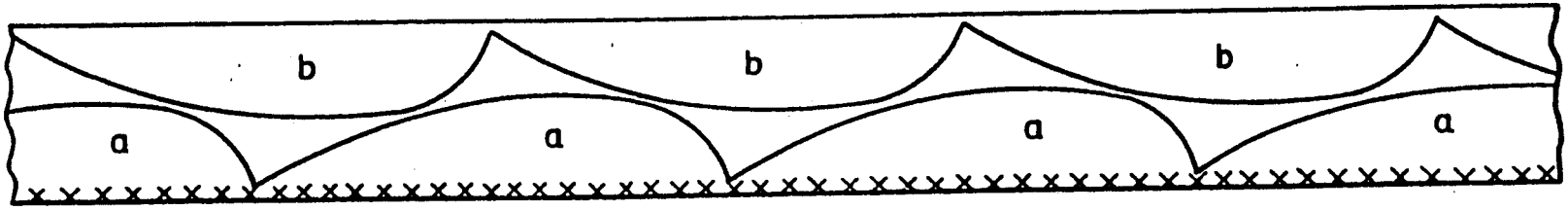
Fig. 3 PRIOR ART
Figure 4:
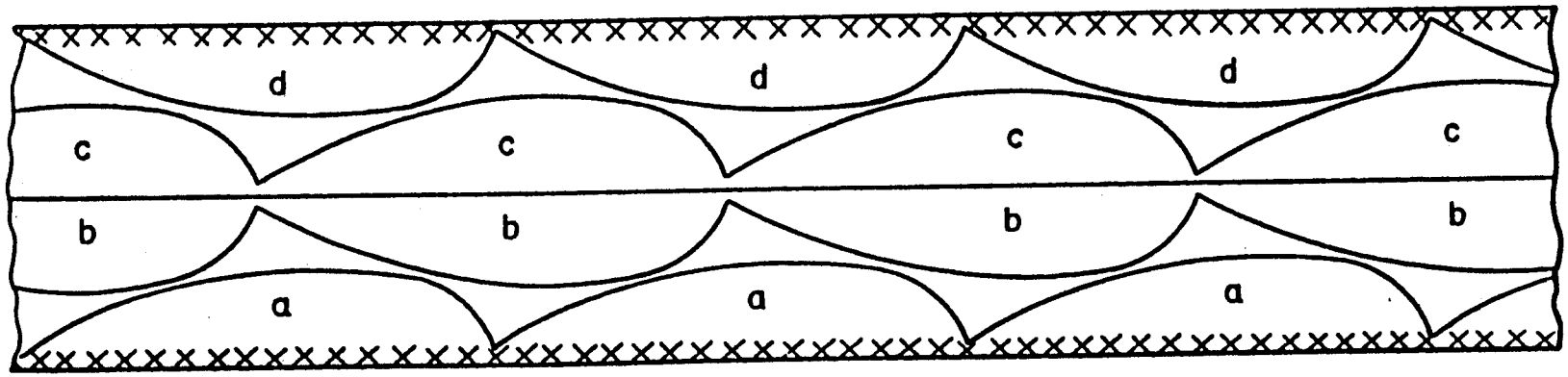
Fig. 4 PRIOR ART

In view of the material utilization efficiency and the ease of cutting, known cutting methods as illustrated in FIGS. 2, 3, and 4 have been proposed.

In FIG. 2, a cutting operation is performed along a predetermined curve upon one side of a material having straight lines on both sides, and the other side thereof remains as it is. Also, as illustrated in FIG. 3 a material having straight lines on both sides is cut along two predetermined curves, and both sides thereof remain as they are. Further, as illustrated in FIG. 4 a material having straight lines on both sides is cut along two or more predetermined curves, and both sides thereof remain as they are (see Kokoku No. 56-80113). That is, in FIG. 2 a series of strips "a" for the wound core 1 are obtained; In FIG. 3, a series of strips "a" and a series of strips "b" for the wound core 1 are obtained; and in FIG. 4, a series of strips "a", a series of strips "b", a series of strips "c", and a series of strips "d" for the wound core 1 are obtained.

In FIG. 2, a large unused area of the material exists and, in FIGS. 3 and 4, unused areas exist between the two adjacent series of strips, thus lowering the utilization efficiency. Also, in FIGS. 2 and 3, if a shaded defective portion is present on one side of the material, the possibility of a generation of defective strips is high. Further, if shaded defective portions are present on both sides of the material, the possibility of a generation of defective strips is also high.

Figure 5A:
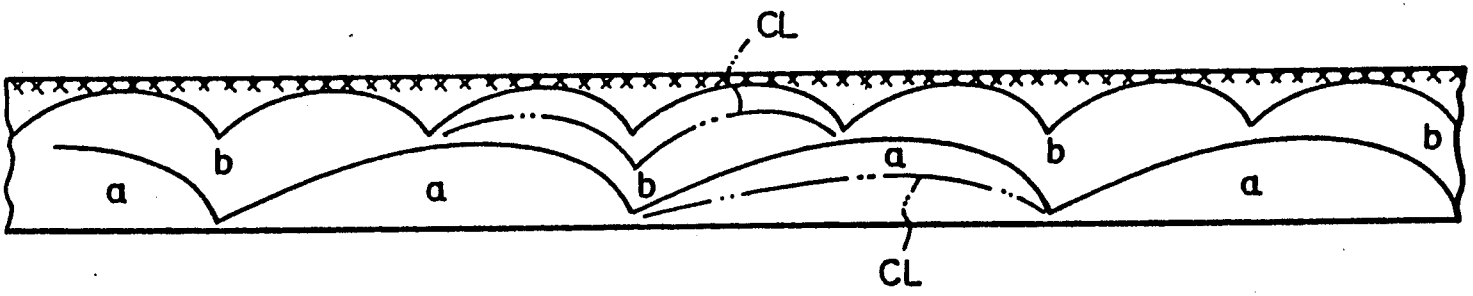
FIGS. 5A and 5B are plan views of a material illustrating a first embodiment of the method of cutting strips for a wound core according to the present invention.
Figure 5B:
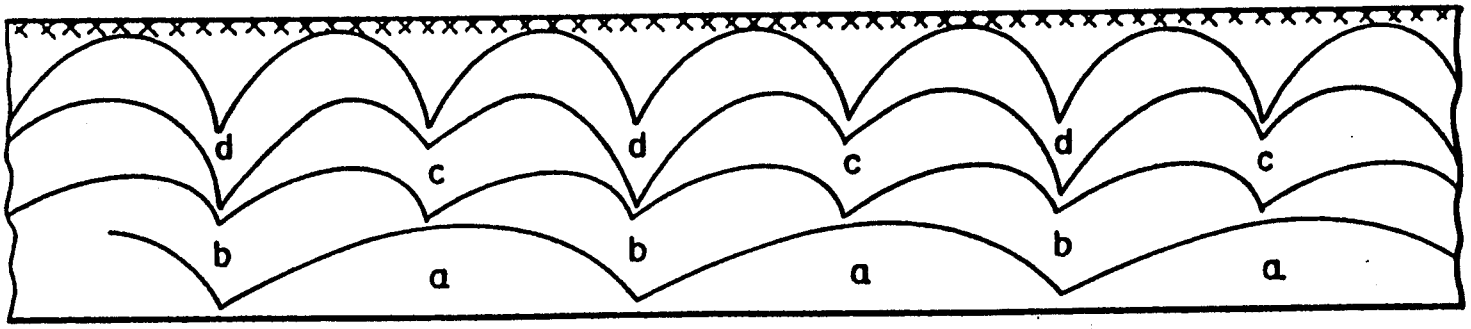

In FIGS. 5A and 5B, which illustrate a first embodiment of the present invention, a series of strips "a" and a series of strips "b" are obtained (FIG. 5A), and further, a series of strips "a", a series of strips "b" a series of strips "c", and a series of strips "d" are obtained (FIG. 5B). Also, in FIGS. 5A and 5B, defective portions exist only on one side of a material. In this case, as shown in FIG. 5A, the series of strips "a" is in direct contact with the series of strips "b", and the maximum width position and the minimum width position of the strips "b" substantially correspond to the minimum width position and the maximum width position of the strips "a", respectively. Note that, since the winding center portion of one strip does not correspond to that of another strip if the maximum width position of the strip "b" corresponds to the minimum width position of the strip "a", the minimum width position of the strip "b" is slightly shifted to the left in FIG. 5A, with respect to the maximum width position. The material utilization efficiency is remarkably improved, as shown in FIG. 5A, in view of the number of defective portions compared with those of the prior art method shown in FIG. 3.

Note that a dot and solid line in FIG. 5A indicates a winding center line.

In FIG. 5B, a series of strips "c" and a series of strips "d" are in direct contact with the strips of FIG. 5A. The maximum width position and the minimum width position of the strip "c" substantially correspond to the maximum width position and the minimum width position of the strip "a", respectively, and the utilization efficiency is further improved compared with the prior art shown in FIG. 4.

Figure 6:
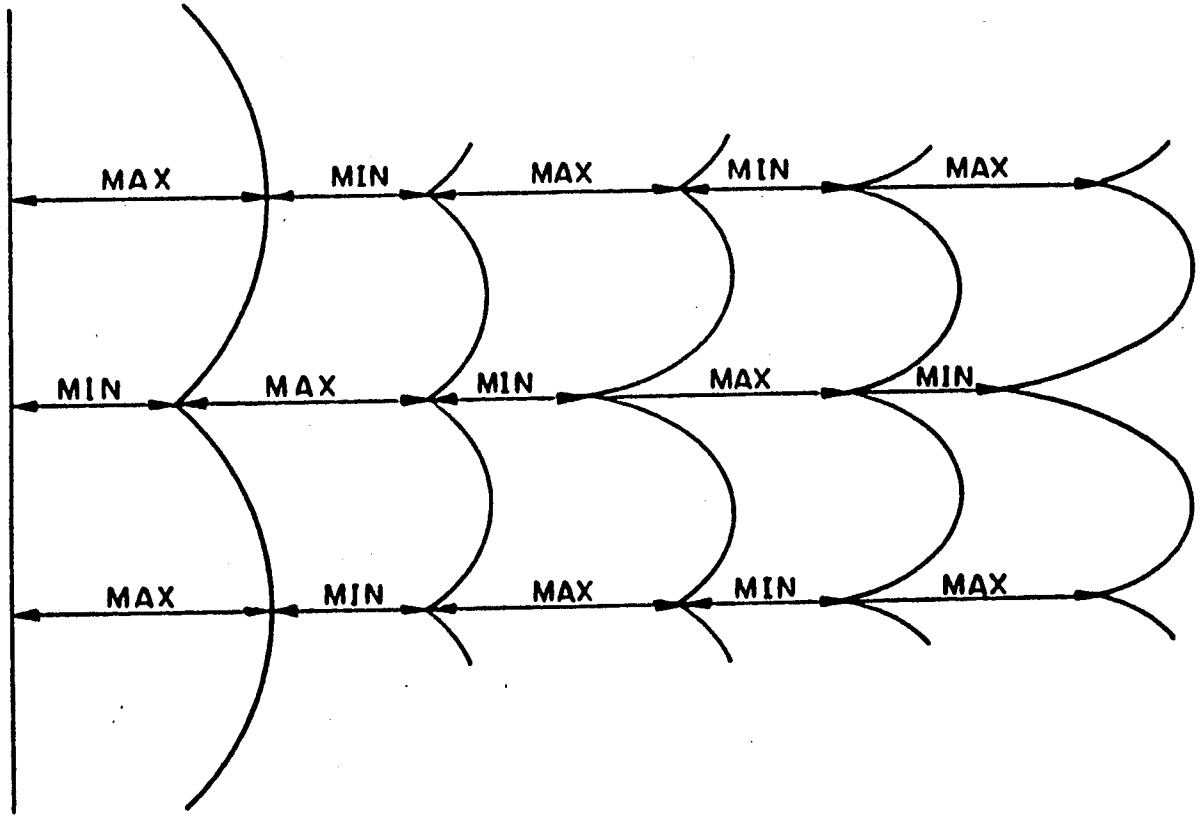
FIG. 6 is a diagram explaining FIGS. 5A and 5B.

Note that, if the four series of strips of FIG. 5B are expanded to become a general multi-series of strips as illustrated in FIG. 6, the maximum width MAX, e.g., 1 cm, and the minimum width MIN, e.g., 0.6 cm, of a series of strips substantially correspond to the minimum width MIN and the maximum width MAX of an adjacent series of strips.

Figure 7A:
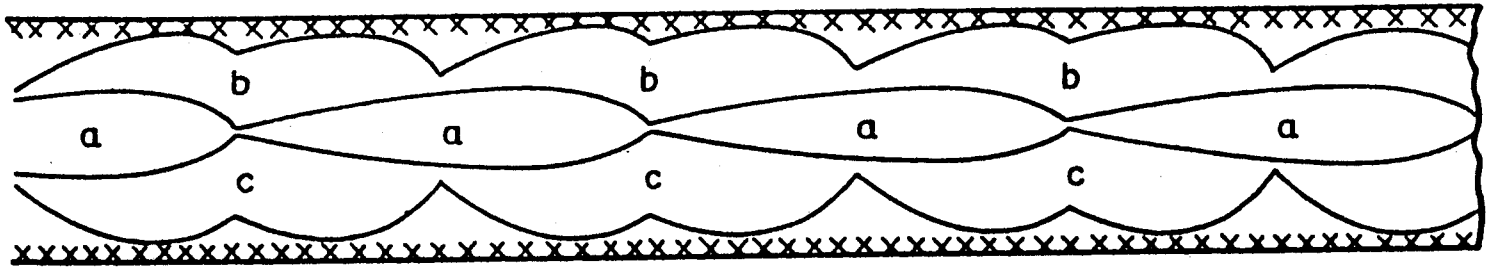
FIGS. 7A and 7B are plan views of a material illustrating a second embodiment of the method of cutting strips for a wound core according to the present invention.
Figure 7B:
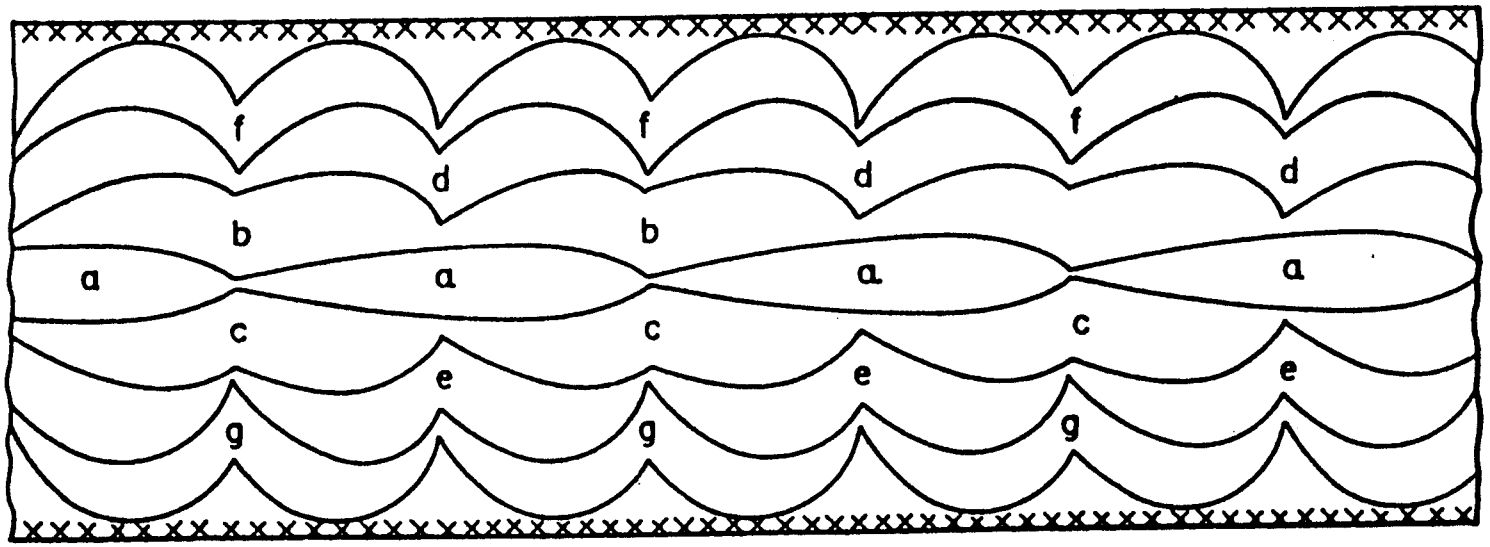
Figure 8:
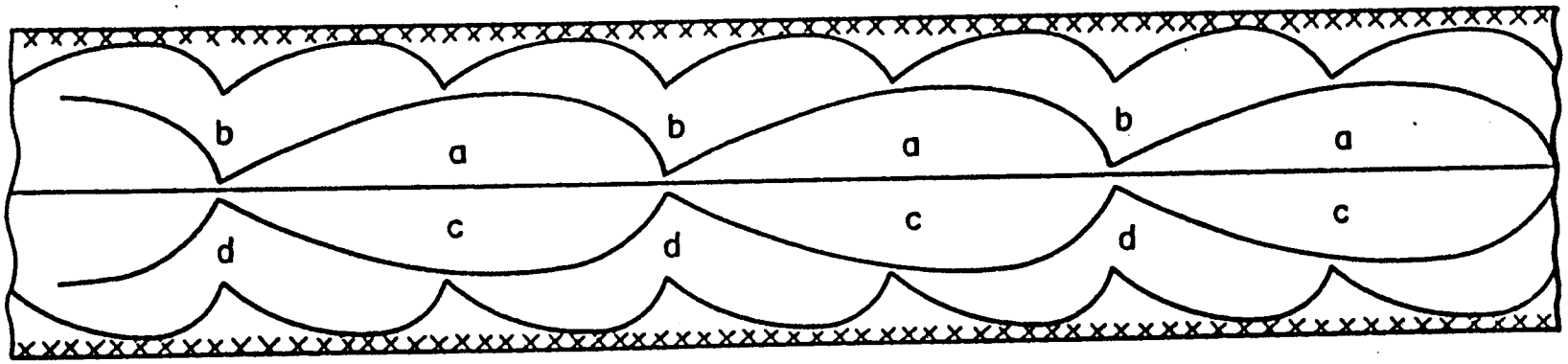
FIG. 8 is a plan view of a material illustrating a third embodiment of the method of cutting strips for a wound core according to the present invention.

In FIGS. 7A and 7B, which illustrate a second embodiment of the present invention, three series, i.e., a series of strips "a", a series of strips "b" and a series of strips "c", are obtained (FIG. 7A) and seven series, i.e., a series of strips "a", a series of strips "b", a series of strips "c", a series of strips "d", a series of strips "e", and a series of strips "f" are obtained (FIG. 7B). In FIGS. 7A and 7B, detective portions exist on both sides of a material, and further, the series of strips "a" are provided at the center of the material and the other series of strips are in direct contact with the immediately adjacent inner side series of strips. The correspondence of the positions of the adjacent series of strips is the same as that of the first embodiment of FIGS. 5A and 5B. The second embodiment is particularly suitable for an odd-number of series of strips. Also, in the second embodiment, in view of the shaded defective portions, the material utilization efficiency is remarkably improved compared with the prior art shown in FIG. 4. Also when the number of series of strips is increased, the utilization efficiency is further improved. In FIG. 8, which illustrates a third embodiment of the present invention, four series, i.e., a series of strips "a", a series of strips "b", a series of strips "c", and a series of strips "d", are obtained. Also, in FIG. 8, shaded defective portions exist on both sides of a material, the two series of strips "a" and "c" are provided at the center of the material, and the other series of strips "b" and "d" are in direct contact with the series of strips "c" and "a" respectively. The correspondence to the positional relationship of the adjacent series is a mirror image relationship with respect to the center of the material. Therefore, the third embodiment is particularly suitable for an even-number of series of strips. In the third embodiment, the material utilization efficiency from the viewpoint of appearance is not improved, compared with the prior art as shown in FIG. 4, but in view of the defective portions, the actual utilization efficiency is improved. Further, if the number of series of strips is increased, the material utilization efficiency is further improved.

Figure 9:
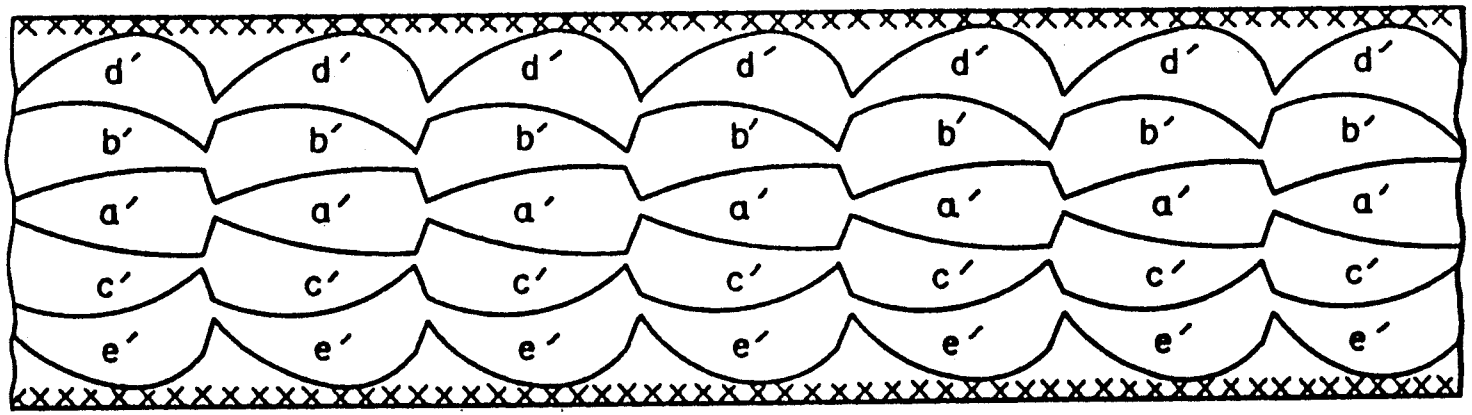
FIG. 9 is a plan view of a material illustrating a fourth embodiment of the method of cutting strips for a wound iron core according to the present invention.

In FIG. 9, which illustrates a fourth embodiment of the present invention, a similar configuration to the second embodiment is illustrated. Note, each of strips "a'" to "e'" is used for semicircular shaped wound cores. In this case, the same effect as in the above-mentioned embodiments can be obtained.

Figure 10A:
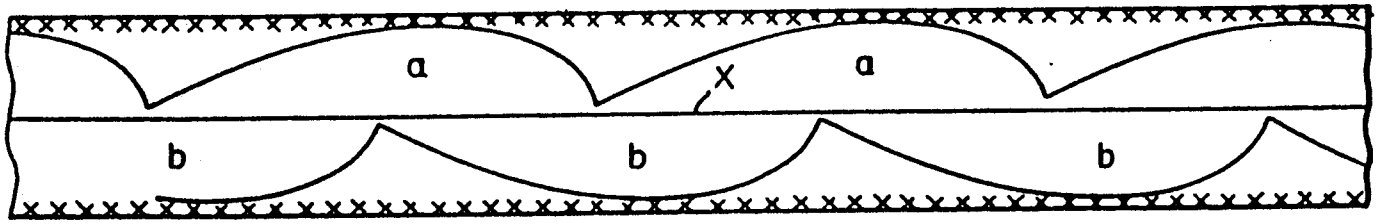
FIGS. 10A and 10B are plan views of a material illustrating a fifth embodiment of the method of cutting strips for a wound iron core according to the present invention.
Figure 10B:
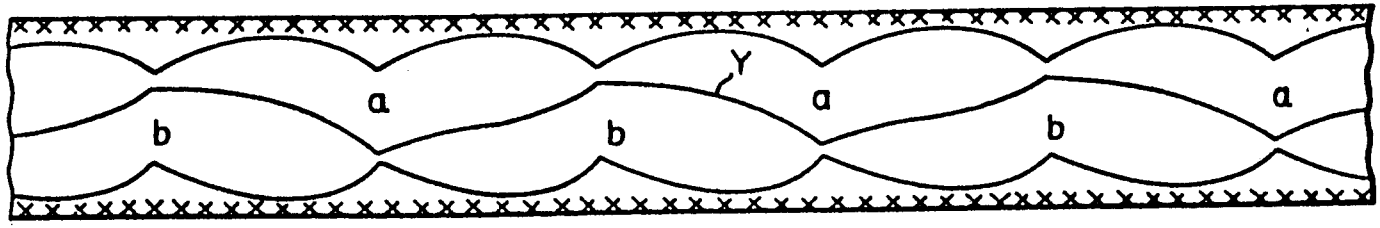

In FIGS. 10A and 10B, which illustrates a fifth embodiment of the present invention, the series of strips of FIG. 3 is improved. That is, in FIGS. 10A and 10B, the series of strips "a" is in direct contact with the series of strips "b". Also the maximum width position and the minimum width position of the strips "a" substantially correspond to the minimum width position and the maximum width position of the strips "b". In FIG. 10A, however, a straight line exists between the series of strips "a" and the series of strips "b", but in FIG. 10B, a curve exists between the series of strips "a" and the series of strips "b". That is, a straight line X of FIG. 10A is changed to a curve Y of FIG. 10B, and as a result, both sides of the two series of FIG. 10B are compressed compared with those of FIG. 10A. In other words, in FIG. 10B, the center position of the two series of strips "a" and "b" defined by three predetermined curves substantially conforms to the center position of the material. Therefore, the utilization efficiency as illustrated in FIG. 10B is improved, since the shaded defective portions on both sides of the material can be removed.

Note that, in practice, the length of a strip is very long, for example, about 20 m, and the width thereof is very narrow, for example, about 1 to 3 cm. Therefore, in the above-mentioned plan views, the length is reduced by 1/200 compared with the width direction.

Also the present invention can be applied to a semicircular cross-sectional wound core and a stepwise cross sectional wound core, in addition to the circular cross-sectional wound core illustrated in FIG. 1.

Figure 11:
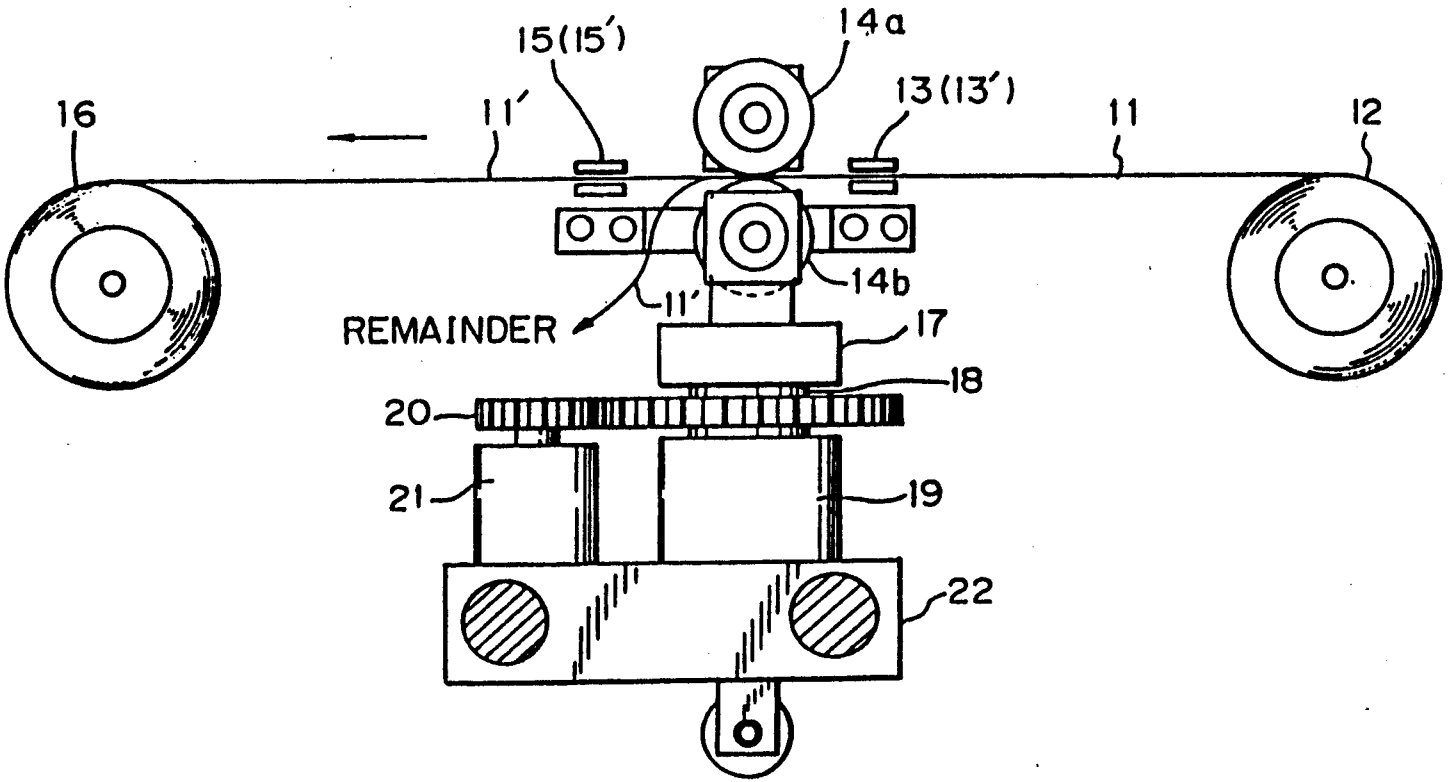
FIG. 11 is a front view of a cutting (slitter) apparatus according to the present invention.
Figure 12:
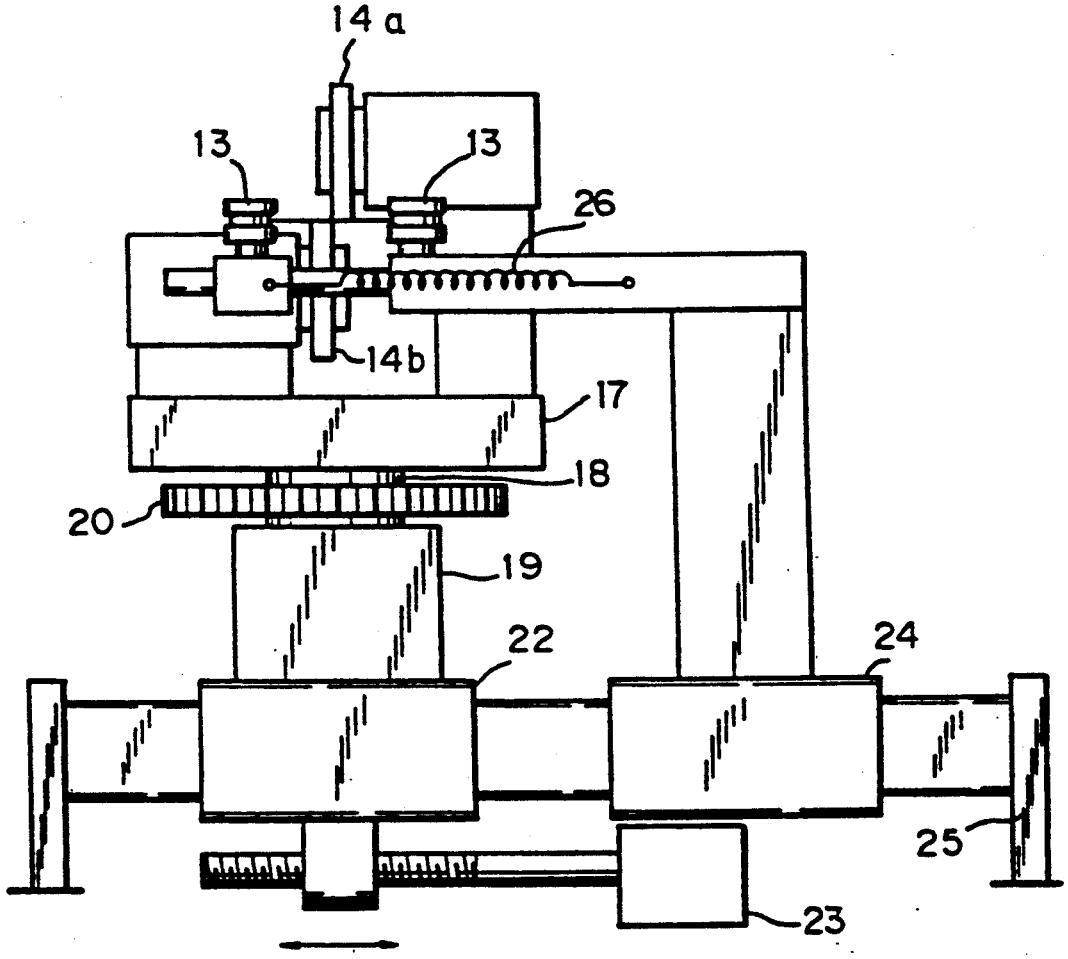
FIG. 12 is a traverse view of FIG. 11.
Figure 13:
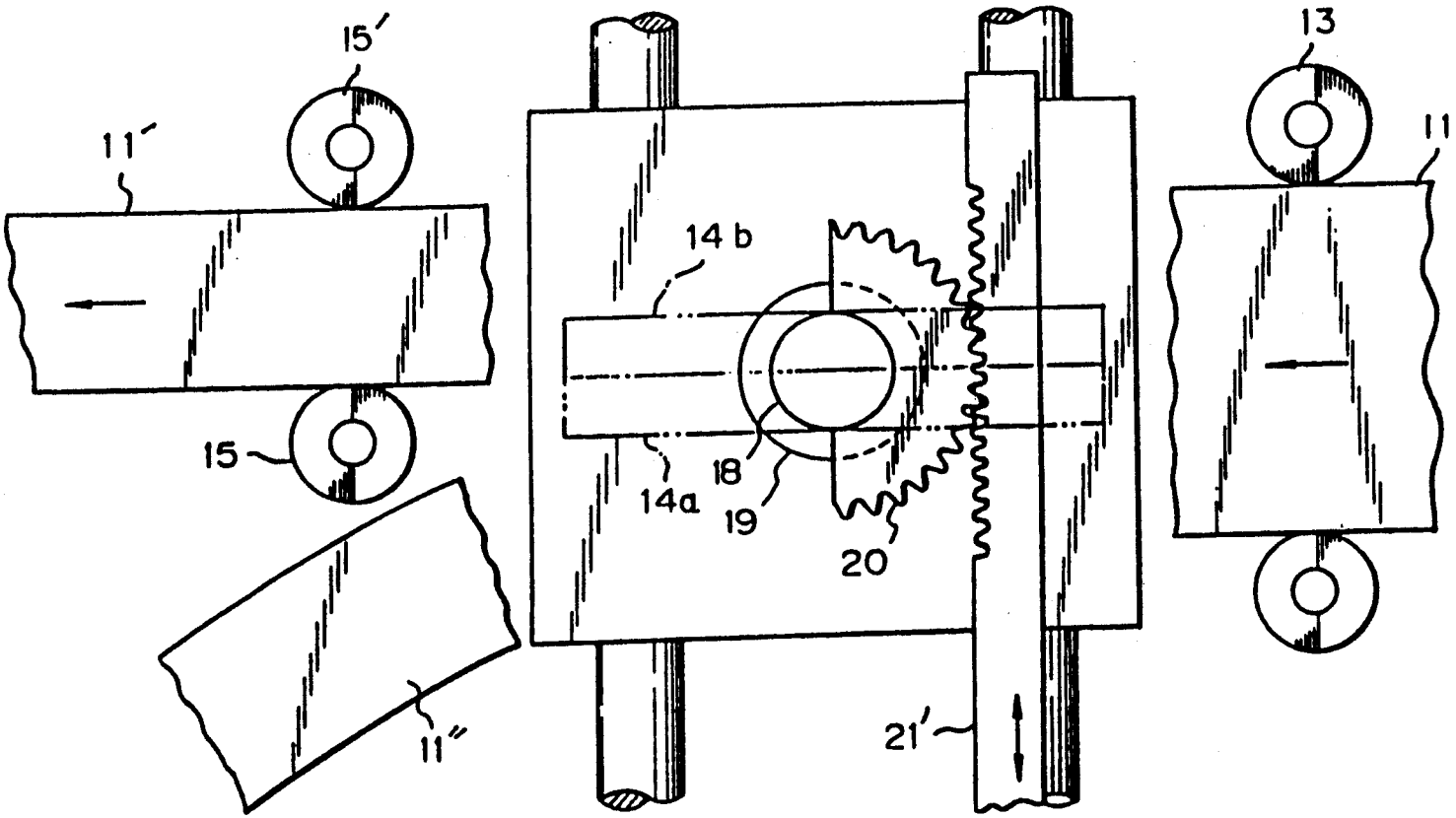
FIG. 13 is a plan view of FIG. 11.

In FIGS. 11, 12, and 13, which illustrated a cutting apparatus according to the present invention for carrying out the above-mentioned cutting methods, a material 11 is supplied from a material coil 12 via a pair of guide rollers 13 (13') to an upper round blade **14*a* and a lower round blade 14*b*. Then, a cut strip 11' is supplied from the round blades 14*a* and 14*b* via a pair of guide rollers 15 (15') to a temporary winding frame 16. The round blades 14*a* and 14*b* are supported by a base 17 which is rotated by a pivot shaft 18. The pivot shaft 18 is supported by a bearing 19. The pivot shaft 18 is rotated by rotating a gear 20 through a driver 21. The bearing 19 and the driver 21 are both mounted on a moving base 22 which can move in a direction perpendicular to the flow of the material 11**.

The moving base 22 is driven by a driver 23 (FIG. 12), as indicated by an arrow. Also, the entire apparatus including the moving base 22 can be driven by moving a base 24 along rails 25. Further, one of the pairs of guide rollers, e.g., 13' and 15', is pulled by springs 26.

In FIG. 13, a rack gear 21' is provided instead of the driver 21.

The apparatus of FIG. 11, 12, and 13 is controlled by a microcomputer (not shown).

Figure 14A:
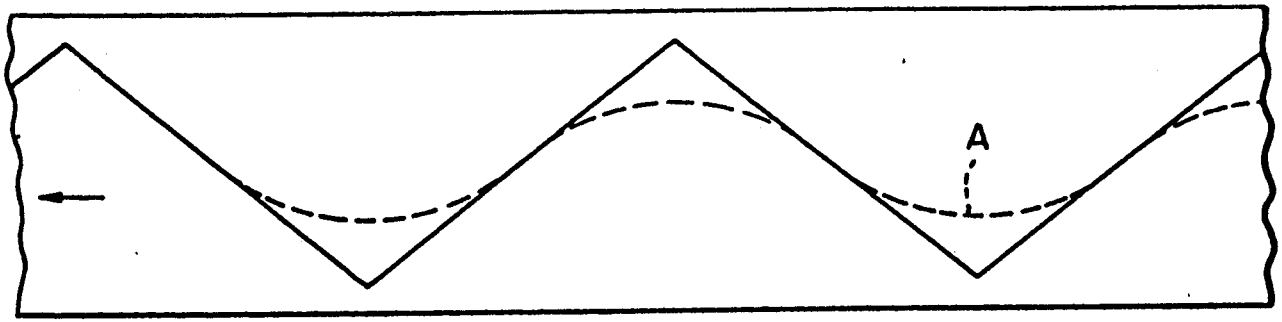
FIGS. 14A and 14B are plan views of a material, for explaining the operation of the slitter apparatus of FIG. 11.
Figure 14B:
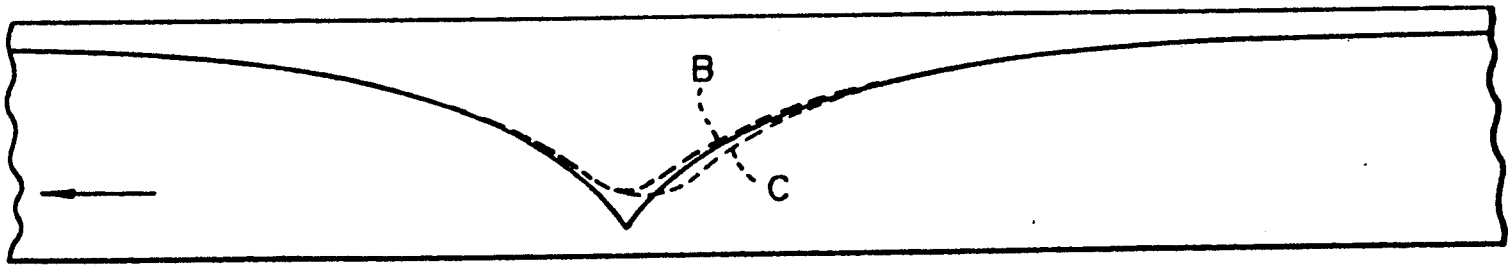

In the apparatus of FIGS. 11, 12, and 13, the pivot shaft 18 is positioned immediately below the round blades **14*a* and 14*b*, and this is one of the features of the present invention. For example, as illustrated in FIG. 14A, if the pivot shaft 18 is positioned upstream of the round blades 14*a* and 14*b*, the actual cut line indicated by a dot line A is shifted from a designated line indicated by a solid line. Contrary to this, as illustrated in FIG. 14B, if the pivot shaft 18 is positioned immediately below the round blades 14*a* and 14*b*, the actual cut line indicated by dot lines B and C is not shifted from a designated line indicated by a solid line. Note that, in FIG. 14B, the dot line B shows the case wherein the running speed of the material 11 is relatively low and the dot line C shows the case wherein the running speed of the material 11** is relatively high.

Also, the apparatus of FIGS. 11, 12, and 13 can be expanded to form an apparatus which simultaneously performs a cutting operation upon the material 11 along a plurality of curves.

As explained above, according to the present invention, since the series of strips are in direct contact with each other, the utilization efficiency can be enhanced. Also, if defective portions exist on one or both sides of the material, the rate of generation of defective products can be reduced, and thus the manufacturing cost can be reduced.

I claim:

1. An apparatus used for cutting a plurality of winding strips for strip material for use in a wound core, comprising:

slitter blade means for cutting said material among predetermined curves so that each one of said plurality of winding strips is in direct continuous contact with another adjacent one of said plurality of winding strips, each one of said winding strips comprises a series of maximum and minimum material width positioned at predetermined intervals along the length of said winding strip, each maximum width position and each minimum width position of each one of said winding strips substantially corresponds to minimum width position and each maximum width position of an adjacent one of said winding strips, respectively; said slitter blade means including an upper slitter biased and a lower slitter blade;

a base supporting said slitter blades;

a pivot shaft having a rotational axis extending through and orthogonally to the rotational axes of said slitter blades and supporting said base in parallel with said material;

guide rollers for sandwiching said material;

an adjusting mechanism for rotating said pivot shaft and moving said base in a plane parallel to the plane in which the material lies and in a direction perpendicular to the flow of said material; and a temporary winding frame for winding a cut plurality of wing strips.

* * * * *

UNITED STATES PATENT AND TRADEMARK OFFICE

CERTIFICATE OF CORRECTION

PATENT NO. : 5,188,305

DATED : February 23, 1993

INVENTOR(S) : Kitamura

It is certified that error appears in the above-identified patent and that said Letters Patent is hereby corrected as shown below:

Column 1, line 7; "07,409,432" should read --07/409,432--.

Column 1, line 39; "curting" should read --cutting--.

Column 1, line 43; "scrathing" should read --scratching--.

Column 1, line 47; "curring" should read --cutting--.

Column 3, line 14; "are" should read --art--.

Column 6, line 34, claim 1; "for" should read --from--.

Column 6, line 45, claim 1; delete "each" after the word "of".

Column 6, line 46, claim 1; insert --each-- after the word "to".

Column 6, line 49, claim 1; "biased" should read --blade--.

Column 6, line 51, claim 1; insert --for-- after the word "base".

Column 6, line 62, claim 1; "wing" should read --winding--.

UNITED STATES PATENT AND TRADEMARK OFFICE

CERTIFICATE OF CORRECTION

PATENT NO. : 5,188,305

DATED : February 23, 1993

INVENTOR(S) : Kitamura

It is certified that error appears in the above-indentified patent and that said Letters Patent is hereby corrected as shown below:

Column 6, line 62, claim 1; "wing" should read --winding--.

Signed and Sealed this

Nineteenth Day of April, 1994

Bruce Lehman

*Attest:*

BRUCE LEHMAN

*Attesting Officer*

*Commissioner of Patents and Trademarks*